US005482159A

United States Patent [19]

Roraback, Jr. et al.

[11] Patent Number: 5,482,159

[45] Date of Patent: Jan. 9, 1996

[54] PIN KIT

[75] Inventors: Gerald G. Roraback, Jr., Litchfield; Richard A. Labbe, Bristol, both of Conn.

[73] Assignee: LAB Security Systems Corporation, Terryville, Conn.

[21] Appl. No.: 247,712

[22] Filed: May 23, 1994

[51] Int. Cl.[6] ..... B65D 69/00

[52] U.S. Cl. ..... 206/223; 206/575; 206/459.5; 382/154; 382/156

[58] Field of Search ..... 206/223, 315.9, 206/459.5, 575; 382/154, 156

[56] References Cited

U.S. PATENT DOCUMENTS

| | | | |
|---|---|---|---|
| 4,195,059 | 3/1980 | Whitcher et al. | 206/459.5 |
| 4,448,304 | 5/1984 | Weinzettel et al. | 206/223 |
| 4,828,113 | 5/1989 | Friedland et al. | 206/459.5 |
| 4,927,015 | 5/1990 | Jones | 206/315.9 |
| 5,394,983 | 3/1995 | Latulippe et al. | 206/459.5 |

OTHER PUBLICATIONS

LAB Product Guide 1992–93.

*Primary Examiner*—David T. Fidei

*Attorney, Agent, or Firm*—St. Onge Steward Johnston & Reens

[57] ABSTRACT

An improved pin kit with features to permit the locksmith to minimize errors in selection and use of lock pins in repinning of a lock. The kit comprises a case, preferably set at an angle, so that the pins located in a transparent pin tray, and indicia located on the underside of the transparent pin tray, are readily visible. The indicia identify pin sizes located in pockets of the pin tray, and are not prone to wear because they are protected by the transparent pin tray. Preferably, the indicia are color coded to match the similarly colored pins. A printed chart is affixed to the case, and also includes pin size identification correlated to the pin color.

24 Claims, 4 Drawing Sheets

PIN KIT

BACKGROUND OF THE INVENTION

1. Field of the Invention

This invention relates to the field of lock-smithing, and in particular, relates to apparatus for containing pins used in repinning and rekeying locks by installing new tumbler pins.

2. Background of the Invention

From time to time, it is necessary to replace the pins in a lock. For example, for security reasons, a person may choose to have the lock keyed to a new key shape after a loss of a door key, or at periodic intervals. In other situations the lock itself may be broken and require new pins.

Prior to this time there have been available in the market various rectangular, flat pin kits containing pins of various sizes for fitting into the locks of a variety of manufacturers. Such "universal" or "mobile" kits have included metal, plastic and wood cases containing a series of pockets for the different pin sizes. In some kits, an opaque plastic pin tray has been used, with pin sizes printed on the upper surface of the pin tray in black type adjacent each pocket.

A universal pin kit may have between about 79–120 different pin sizes. The pin sizes typically increase by a fixed increment, for example a case may contain pins in 5/1000 inch increments, i.e., 0.010, 0.015, 0.020, etc.; or in 3/1000 inch increments, i.e. 0.009, 0.012, 0.015, 0.018., etc. In some kits, the pins are colored according to their size. Typically, six (6) different colors are used, in a regular sequence, to distinguish pins of different sizes.

Such kits have also included a pinning chart, containing a series of tables which each identify a particular manufacturer of a lock and lists the lock manufacturer's pin numbers and correlates the pin number to the corresponding size pin contained in the kit that will fit as a replacement for the pin identified by the manufacturer's pin number. Such pinning charts have heretofore only been available in black and white printing.

It has been found in connection with the known pin kits that the pin size information printed on the pin tray will become worn over time, making it difficult for the locksmith to determine the size of the pins held in a particular pin tray pocket, and potentially, causing errors such as the selection of the wrong size pin, with resultant need for rework of an improperly assembled lock.

It has also been found that with conventional pin kits the locksmith working at a workbench will tend to stand and lean over the kit to locate and select pins, particularly when the pins are located at the rear of the kit. This has the potential of causing back strain, particularly if the locksmith spends long periods in a bent over position.

It has also been found in practice that the locksmith's work will take him to poorly lit locations and/or that illumination that may be available inside of the locksmith's vehicle may be poor. The poor illumination may also cause errors in selecting the proper size pin, with resulting loss of time and efficiency if it is necessary to rework the lock.

OBJECTS OF THE INVENTION

It is an object of the present invention to provide an improved pin kit that addresses the above problems, and to provide a pin kit where the locksmith will be able to correctly identify the correct size lock pin desired, and retrieve that pin, with a minimum chance of selecting the wrong pin.

In particular it is an object of the invention to provide a pin kit in which pin size information is permanent and will not become worn, and to provide a pin size/pin color correlation to permit the locksmith to doublecheck that the pin he is selecting is the correct size pin.

It is a further object of the invention to make it simpler and easier for a locksmith to identify and locate lock pins of a desired size from a seated position. It is a further object of the invention to provide a means to make lock pin size information, and the lock pins themselves, easier to find in poorly illuminated workplaces.

Other objects, aspects and features of the present invention in addition to those mentioned above will be pointed out in or will be understood from the following detailed description provided in conjunction with the accompanying drawings.

SUMMARY OF THE INVENTION

A pin kit in accordance with the invention comprises a case, a transparent pin tray containing pin pockets located in the case, pins of different sizes and colors in the different pin pockets, indicia identifying pin size located on the lower surface of the pin tray, and a printed chart affixed to the case and which contains information displaying a correlation between the specific color of, and the size of, each pin.

The case has a case body and a case lid. The case body is canted so that the pin tray sits at an angle relative to a horizontal plane. This angling may be achieved by forming the case body with a rear wall which is taller than its front wall; alternatively, swing down rear legs or a detachable angled support bracket might be used. Preferably, the pin tray is angled relative to the horizontal plane at an angle of between about five degrees to about twenty-five degrees, and most preferably at an angle of about ten degrees.

The transparent pin tray has an array of pin reservoir pockets extending downwardly. Indicia for identification of the pin size are placed beneath the transparent pin tray and are visible therethrough. In a preferred embodiment, the indicia are printed on an insert. The insert is located between the pin tray and the case and has a plurality of apertures into which are fitted the pin reservoir pockets. Most preferably, the indicia are colored to match the color of pin size identified by the indicia.

In a preferred embodiment of the pin kit, it further comprises a light located inside the body of the case, wherein the light illuminates the insert and pin tray to improve visibility of the pins and the indicia.

BRIEF DESCRIPTION OF THE DRAWINGS

The present invention may be more clearly understood from the following description of a specific and preferred embodiment read in conjunction with the accompanying schematic and detailed drawings; wherein.

DETAILED DESCRIPTION OF DRAWINGS

Figure 1:
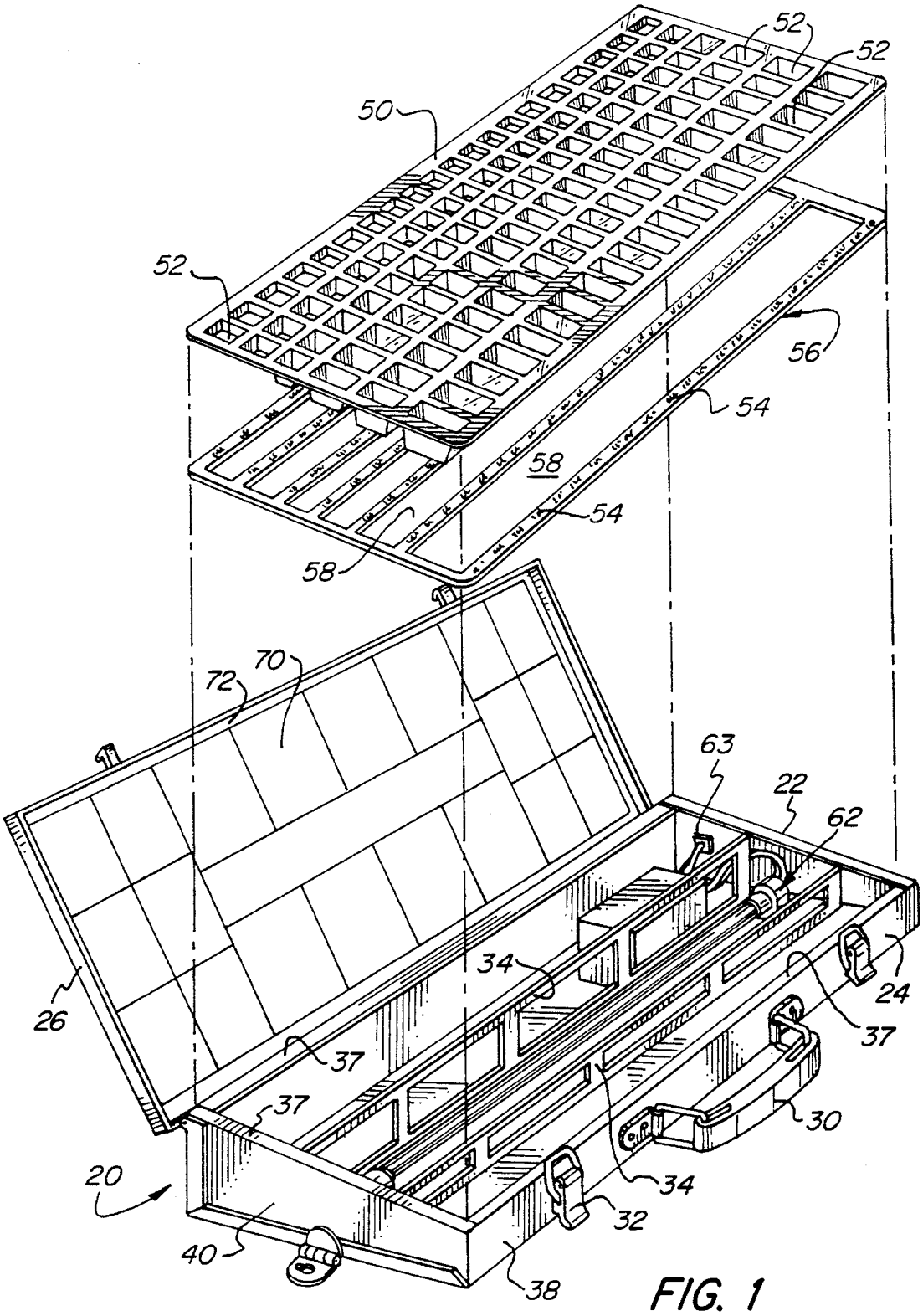
FIG. 1 is a perspective exploded view of an embodiment of a pin kit in accordance with the invention.
Figure 2:
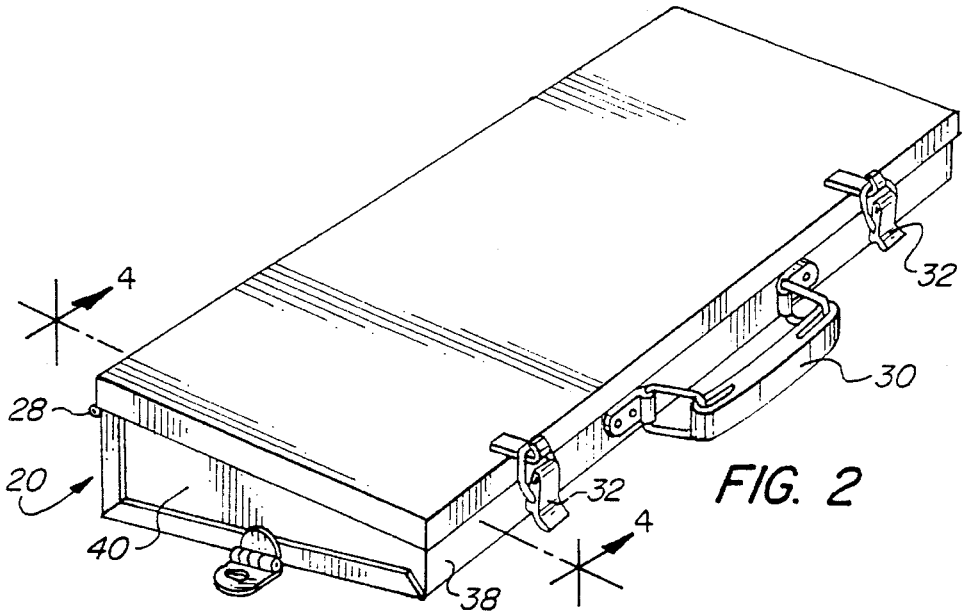
FIG. 2 is a perspective view of an embodiment of a pin kit in accordance with the invention.
Figure 3:
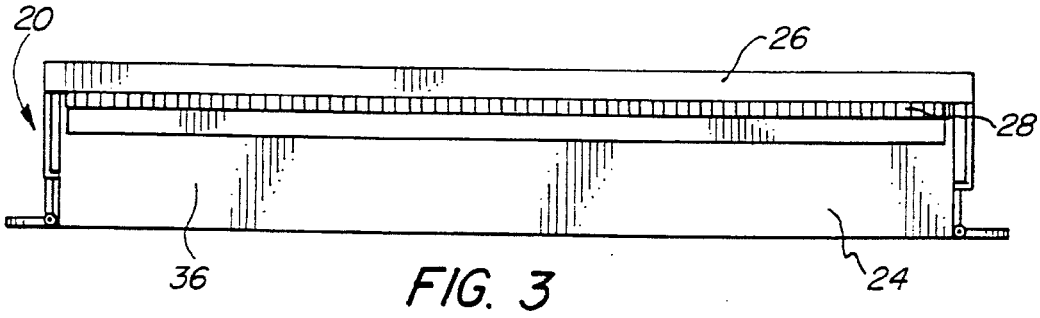
FIG. 3 is a rear elevation view of the pin kit of FIG. 2.

Referring to FIGS. 1–8, a pin kit 20 in accordance with the invention comprises a case 22, a transparent pin tray 50 located in the case 22, pins 60 of different sizes and colors located in the pin pockets, indicia 54 identifying pin size located on the lower surface of the pin tray 50, and a printed information chart 70.

Figure 4:
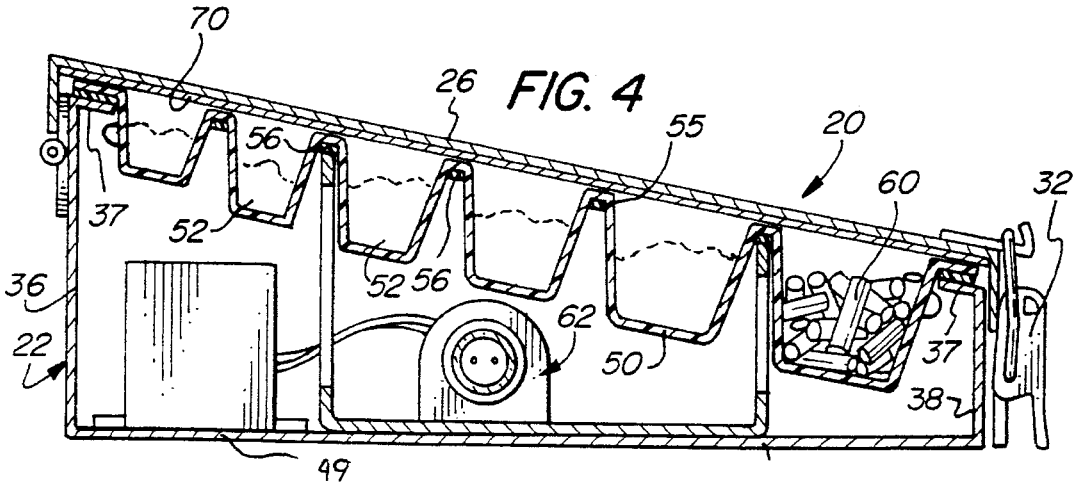
FIG. 4 is a cross sectional view of the pin kit of FIG. 2 along the line 4—4 of FIG. 2.
Figure 5:
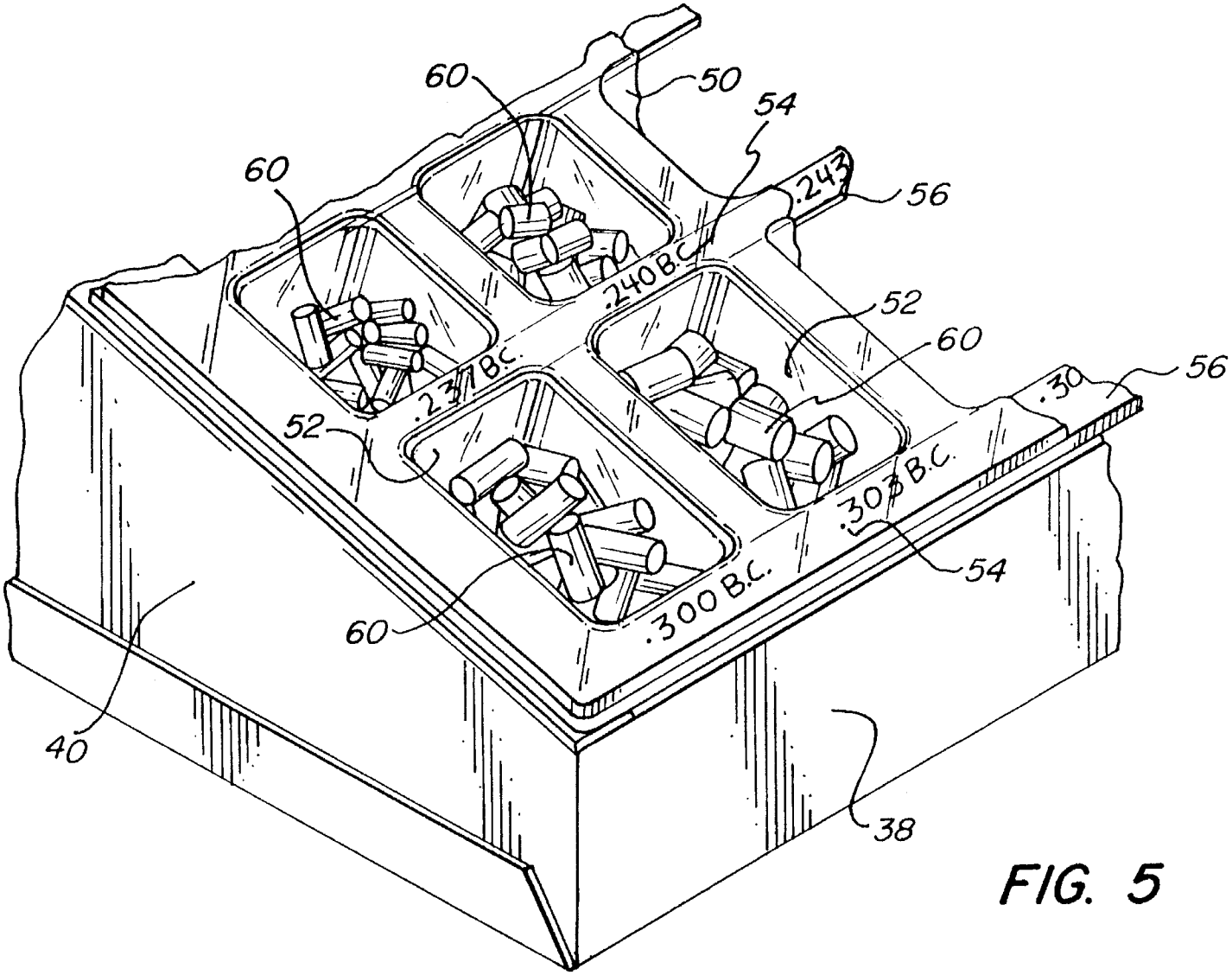
FIG. 5 is a detail perspective view of a pin tray and insert in a pin kit in accordance with one embodiment of the invention.

The case 22 has a case body 24 and a case lid 26 joined together along one rear edge by a hinge 28. Case 22 preferably is rectangular in top plan view and wedge shaped in side elevation view, as shown in FIG. 4. Case body 24 has a handle 30 and hasps 32. Case body 24 has internal support ribs 34 for supporting pin tray 50.

Figure 6:
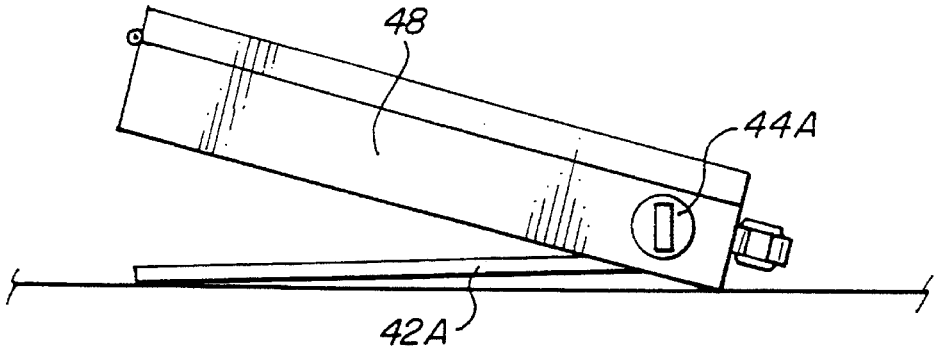
FIG. 6 is a side elevation view of an embodiment of a pin kit in accordance with the invention.
Figure 7:
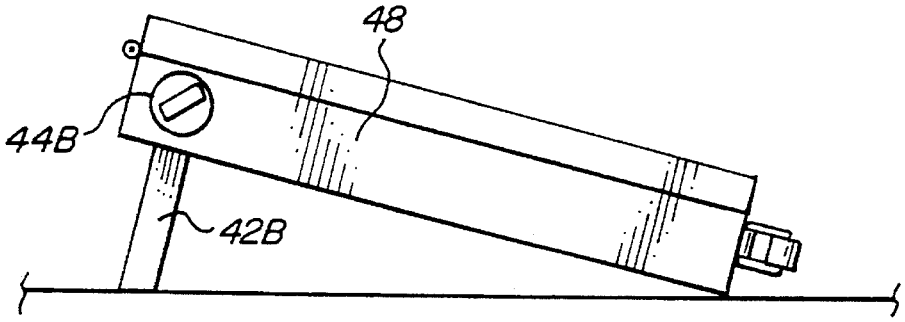
FIG. 7 is a side elevation view of an embodiment of a pin kit in accordance with the invention.
Figure 8:
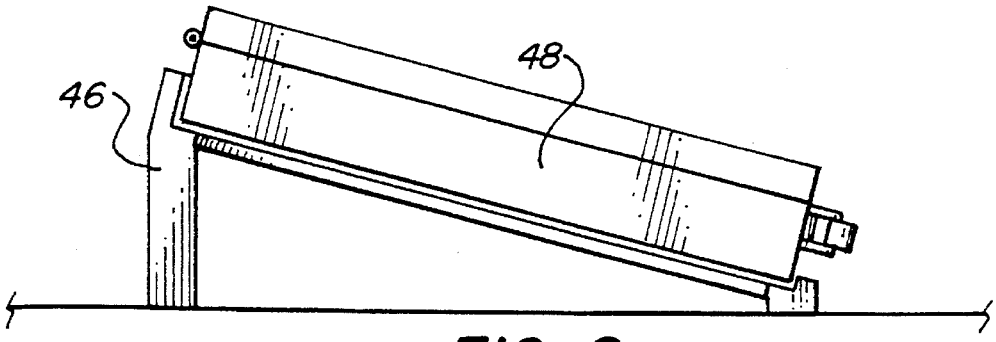
FIG. 8 is a side elevation view of an embodiment of a pin kit in accordance with the invention.

Case body 24 is angled so that pin tray 50 sits at an angle relative to a horizontal plane. The angling is preferably achieved by forming the case body with a rear wall 36 which is taller than its front wall 38, as shown in FIG. 4. In this situation the side walls 40 will have angled upper surfaces to connect the front and rear walls. Alternatively, swing down legs 42 may be provided in a flat rectangular case body 48 as shown in FIGS. 6 and 7. In the embodiment shown in FIG. 6, legs 42A are nested into the underside of case body 24 and are actuated by knob 44A to swing down from a hinge point at the front of the case. In the embodiment shown in FIG. 7, legs 42B are nested in the underside of case body 24 and are actuated by knob 44B to swing down from a hinge point at the rear of the case. In another embodiment shown in FIG. 8, a detachable support bracket or saddle 46 may support a conventional flat rectangular case 48 to provide an angled presentation of the pin tray.

Preferably, the pin tray 50 is angled relative to the horizontal plane at an angle of between about five degrees to about twenty-five degrees, and most preferably at an angle of about ten degrees. In the case 22 of FIGS. 1–4, the horizontal plane can be defined by the lower base wall 49 connecting the lower edges of the front and rear walls 38,36.

Preferably, case 22 is fabricated from sheet metal; however, other materials, such as plastics, may also be used.

The transparent pin tray 50 has an array of pin reservoir pockets 52 extending downwardly into case 22. The transparent pin tray is made of a plastic material, preferably PETG. The pin tray 50 is supported by the upper surfaces of the front and rear walls 38,36, and side walls 40, which may have inwardly bent edges 37 to support pin tray 50. Indicia 54 for identification of a pin size are located on the lower surface 55 of the transparent pin tray and are visible therethrough. In a preferred embodiment, the indicia 54 are printed on an insert 56. The insert 56 is located between the pin tray 50 and the case 22 and has a plurality of apertures 58 into which are fitted the pin reservoir pockets 52.

A plurality of incrementally sized pins 60 are located in the pockets 52. Each pocket 52 contains a differently sized pin 60 and will have a different indicia 54 visible adjacent such pocket 52. The pins are preferably made of brass. Each pin 60 of a specific size is colored a specific color, using metal dyes or plating. This color coding is preferably also used in the indicia, as noted above. The indicia 54 will then show the pin size printed in ink of the same color as the pin color. Thus, for example, if a bottom crown pin of 0.240 inch is colored green, the indicia 54 will state "0.240" and will be printed in green color ink.

In a preferred embodiment of the pin kit 20, the kit 20 further comprises a light 62 located inside the body 24 of the case 22, wherein the light 62 illuminates the insert 56 and pin tray 50 to improve visibility of the pins and the indicia 54. The light 62 will be switched and may be battery powered, and/or provide for attachment to a 12 volt automotive system and/or household 120 VAC. In the embodiment shown in FIG. 4, the light 62 comprises a battery powered florescent bulb with any appropriate switch 63 located on the exterior of case 22.

An arrangement of color coded information is also affixed to the case 22. The information displays a correlation between the specific color and size of each pin. In the preferred embodiment, the arrangement of color coded information comprises a printed chart 70 affixed to an inner surface 72 of the case lid 26. The chart is preferably printed on heavy laminate stock, and preferably includes a coating permitting inscription thereon with a writing instrument and which can also be wiped clean. In the preferred embodiment, chart 70 will, like indicia 54, show the pin size printed in ink colored to match the color of the pin of that pin size. Thus, for example, under a list of pin sizes for replacing pins of locks sold under the trademark "Schlage", the above referenced 0.240 inch bottom crown pin will be identified as "0.240" in green ink on chart 70. Other indications of the pin color may be used, for example, bars of color located beside, or beneath, or behind each pin size printed on chart 70.

The pin kit 20 described herein addresses all of the identified problems associated with prior art devices. The locksmith is given substantially improved efficiency and verification or proper pin size by use of color coded information on the in chart 70 to correlate the pin color to the pin size. Also, the use of indicia that will not wear out, because they are beneath the transparent pin tray, reduces the chance of errors from worn, illegible, pin size information. The wedge shape of the kit provides a striking visual appearance unique in the marketplace, and prevents back fatigue associated with flat kits. Finally, the illumination provides better ability to use the kit in poor light conditions.

In view of the above, it is clear that the invention provides a unique kit that gives the locksmith substantial flexibility and ease of use that will prevent errors of sizing possible with prior art kits. The present invention provides a substantial advancement over the art.

We claim:

1. A pin kit comprising:

a case having a case body and a case lid, said case body having a front wall and a rear wall, said front wall having a lower height than said rear wall, said case body having side walls connecting said front and rear;

a transparent pin tray having an array of pin reservoir pockets extending downwardly from a planar sheet, said pin tray being supported by said case body, whereby said pin tray is angled relative to a horizontal plane;

an insert located between said pin tray and said case, said insert having a plurality of apertures, said pin reservoir pockets extending through said plurality of apertures and said insert being located against a lower surface of said planar sheet of said pin tray, said insert being provided on an upper surface thereof with indicia thereon for identification of pins, said indicia being visible through said transparent pin tray;

a plurality of incrementally sized pins, each pin of a selected size being colored a specific color, said pins being located in said pin reservoir pockets, said indicia being visible adjacent each said pin reservoir pocket to identify the size of the pins located in said pin reservoir pockets;

an arrangement of color coded information affixed to said case, said information displaying a correlation between the said specific color and the said size of each pin.

2. A pin kit in accordance with claim 1, wherein said indicia are colored to match the color of the size of pin identified by said indicia.

3. A pin kit in accordance with claim 1, wherein said arrangement of color coded information comprises a printed chart affixed to an inner surface of said case lid.

4. A pin kit in accordance with claim 3, wherein said chart is coated with a laminate permitting inscription thereon with a writing instrument and which can also be wiped clean.

5. A pin kit in accordance with claim 1, wherein said pin tray is angled relative to said horizontal plane at an angle of between about five degrees to about twenty-five degrees.

6. A pin kit in accordance with claim 5, wherein said pin tray is angled relative to said horizontal plane at an angle of about ten degrees.

7. A pin kit in accordance with claim 1, further comprising a light located inside said body of said case, wherein said light illuminates said insert and pin tray to improve visibility of said pins and said indicia.

8. A pin kit comprising:

a case having a case body and a case lid, said case body having a front wall and a rear wall, said case having side walls connecting said front and rear;

a transparent pin tray having an array of pin reservoir pockets extending downwardly from a planar sheet, said pin tray being supported by said case body;

means for elevating an upper surface of said rear wall relative to an upper surface of said front wall, whereby said pin tray is angled relative to a horizontal plane;

indicia for identification of pins, said indicia being located beneath said transparent pin tray and being visible through said transparent pin tray;

a plurality of incrementally sized pins, each said pin of a specific size being colored a specific color, said pins being located in said pin reservoir pockets, said indicia being visible adjacent each said pin reservoir pocket to identify the size of the pins located in said pin reservoir pockets;

an arrangement of color coded information affixed to said case, said information displaying a correlation between said specific color and said size of each pin.

9. A pin kit in accordance with claim 8, further comprising an insert located between said pin tray and said case, said insert having a plurality of apertures, said pin reservoir pockets extending through said plurality of apertures and said insert being located against a lower surface of said planar sheet of said pin tray, said indicia being provided on an upper surface of said insert.

10. A pin kit in accordance with claim 8, wherein said means for elevating said upper surface of said rear wall relative to said upper surface of said front wall comprises a pair of support legs affixed to said case body and movable between lowered and raised positions.

11. A pin kit in accordance with claim 8, wherein said means for elevating said upper surface of said rear wall relative to said upper surface of said front wall comprises a removable support bracket connectable to said case body adjacent said rear wall of said body.

12. A pin kit in accordance with claim 8, wherein said means for elevating said upper surface of said rear wall relative to said upper surface of said front wall comprises providing said rear wall with a greater height than said front wall, and providing said side walls with angled upper surfaces.

13. A pin kit in accordance with claim 8, wherein said pin tray is angled relative to said horizontal plane at an angle of between about five degrees to about twenty-five degrees.

14. A pin kit in accordance with claim 8, further comprising a light located inside said body of said case, wherein said light illuminates said insert and pin tray to improve visibility of said pins and said indicia.

15. A pin kit in accordance with claim 8, wherein said arrangement of color coded information comprises a printed chart affixed to an inner surface of said case lid.

16. A pin kit comprising:

a case having a case body and a case lid, said case body having a front wall and a rear wall, said front wall having a lower height than said rear wall, said case body having side walls connecting said front and rear;

a transparent pin tray having an array of pin reservoir pockets extending downwardly from a planar sheet, said pin tray being supported by said case body whereby said pin tray is angled relative to a horizontal plane;

an insert located between said pin tray and said case, said insert having a plurality of apertures, said pin reservoir pockets extending through said plurality of apertures and said insert being located against a lower surface of said planar sheet of said pin tray, said insert being provided on an upper surface thereof with indicia for identification of pin size, said indicia being visible through said transparent pin tray;

a plurality of pins of incremental sizes, each pin of a size being colored a specific color, said pins being located in said pin reservoir pockets, said indicia being visible adjacent each said pin reservoir pocket to identify the pins located in each pin reservoir pocket;

a printed chart affixed to an inner surface of said case lid having printed thereon color coded information, said information displaying a correlation between said specific color and pin size.

17. A pin kit in accordance with claim 16, wherein said pin tray is angled relative to said horizontal plane at an angle of between about five degrees to about twenty-five degrees.

18. A pin kit in accordance with claim 17, wherein said pin tray is angled relative to said horizontal plane at an angle of about ten degrees.

19. A pin kit in accordance with claim 18, further comprising a light located inside said body of said case, wherein said light illuminates said insert and pin tray to improve visibility of said pins and said indicia.

20. A pin kit comprising:

a case having a case body and a case lid, said case body having a front wall and a rear wall, said case having side walls connecting said front and rear;

a transparent pin tray having an array of pin reservoir pockets extending downwardly from a planar sheet, said pin tray being supported by said case body;

indicia for identification of pins, said indicia being located beneath said transparent pin tray and being visible through said transparent pin tray;

a plurality of pins of incremental sizes, each pin of a size being colored a specific color, said pins being located in said pin reservoir pockets, said indicia being visible adjacent each said pin reservoir pocket to identify the size of the pins located in said pin reservoir pocket;

a printed chart affixed to an inner surface of said case lid, said chart containing information displaying a correlation between said specific color and pin size.

21. A pin kit in accordance with claim 20, wherein said chart is coated with a laminate permitting inscription thereon with a writing instrument and which can also be wiped clean.

22. A pin kit in accordance with claim 21, further comprising an insert located between said pin tray and said case, said insert having a plurality of apertures, said pin reservoir pockets extending through said plurality of apertures and said insert being located against a lower surface of said planar sheet of said pin tray, said indicia being provided on an upper surface of said insert.

23. A pin kit in accordance with claim 22, wherein said indicia are colored to match the color of the pin identified by said indicia.

24. A pin kit in accordance with claim 22, further comprising a light located inside said body of said case, wherein said light illuminates said insert and pin tray to improve visibility of said pins and said indicia.

* * * * *